US007458568B2

(12) United States Patent
Pichlmeier et al.

(10) Patent No.: US 7,458,568 B2
(45) Date of Patent: Dec. 2, 2008

(54) METHOD FOR COMPENSATING A GEAR BACKLASH AND APPARATUS FOR CARRYING OUT SAID METHOD

(75) Inventors: Robert Pichlmeier, Kirchheim (DE); Otto Ferber, Germering (DE)

(73) Assignee: Oce Printing Systems GmbH, Poing (DE)

( * ) Notice: Subject to any disclaimer, the term of this patent is extended or adjusted under 35 U.S.C. 154(b) by 678 days.

(21) Appl. No.: 10/491,088

(22) PCT Filed: Sep. 26, 2002

(86) PCT No.: PCT/EP02/10835

§ 371 (c)(1),
(2), (4) Date: Mar. 17, 2005

(87) PCT Pub. No.: WO03/029903

PCT Pub. Date: Apr. 10, 2003

(65) Prior Publication Data

US 2005/0158076 A1 Jul. 21, 2005

(30) Foreign Application Priority Data

Sep. 27, 2001 (DE) ..... 101 47 684

(51) Int. Cl.
*B65H 5/00* (2006.01)

(52) U.S. Cl. ..... 271/10.01; 74/409

(58) Field of Classification Search ..... 74/209, 74/409; 271/10.01
See application file for complete search history.

(56) References Cited

U.S. PATENT DOCUMENTS

| | | | | |
|---|---|---|---|---|
| 4,061,222 | A | 12/1977 | Rushing | |
| 4,174,171 | A | 11/1979 | Hamaker et al. | |
| 4,493,571 | A * | 1/1985 | Potter | 400/144.2 |
| 5,248,027 | A | 9/1993 | Kluger et al. | |
| 5,717,984 | A | 2/1998 | Wong | |
| 5,729,100 | A * | 3/1998 | Rothstein et al. | 318/7 |
| 6,255,645 | B1 * | 7/2001 | Gardner et al. | 250/231.13 |
| 6,611,823 | B1 * | 8/2003 | Selmic et al. | 706/14 |
| 6,695,505 | B2 * | 2/2004 | Iimura et al. | 400/636.2 |
| 2003/0181999 | A1 * | 9/2003 | Spindler et al. | 700/69 |
| 2005/0238544 | A1 * | 10/2005 | Briscoe et al. | 422/100 |
| 2007/0249460 | A1 * | 10/2007 | Schulz et al. | 475/342 |

FOREIGN PATENT DOCUMENTS

| | | |
|---|---|---|
| EP | 0 608 124 A2 | 1/1994 |
| EP | 0 699 968 A1 | 8/1995 |
| JP | 0408065 | 3/1992 |
| WO | 99/08374 | 2/1999 |
| WO | 00/34831 | 6/2000 |
| WO | 01/11432 A1 | 2/2001 |

* cited by examiner

*Primary Examiner*—David H Bollinger
(74) *Attorney, Agent, or Firm*—Schiff Hardin LLP

(57) ABSTRACT

An electrographic printer using a print web medium is provided with a web adjusting apparatus having a geared motor for adjusting the web position. A method and apparatus to compensate for backlash in the geared motor includes a sensor to detect an end position of rotation of the geared motor. A time being determined from a point of reversal of the geared motor to a decay in the sensor output indicating a gear backlash, and the time being added to the drive of the geared motor when reversing directions to adjust the web position.

18 Claims, 3 Drawing Sheets

METHOD FOR COMPENSATING A GEAR BACKLASH AND APPARATUS FOR CARRYING OUT SAID METHOD

BACKGROUND OF THE INVENTION

1. Field of the Invention

The present invention relates to a method for compensating gear backlash of a geared motor, the geared motor being operated in particular in an electrophotographic printing machine in order to bring about the alignment of a print medium web. An apparatus for carrying out this method is likewise provided.

2. Description of the Related Art

From U.S. Pat. No. 4,061,222, an apparatus is known that detects the edge of a band or belt and continuously adjusts the edge to a particular position via a tiltable roller over which the belt runs. Here, a sensor acquires the edge of the band or belt, and the sensor output is used to control a geared motor that correspondingly pivots the tiltable roller. A compensation of a gear backlash of the geared motor is not known from this reference.

From U.S. Pat. No. 4,174,171, a mechanical solution is known for holding a belt or band in a particular position. Here a roller over which the belt runs is held by a support that is in turn fastened to a steering post that can rotate freely. As soon as the belt has moved laterally out of the target position, a corresponding force is exerted on the steering post, so that this steering post is rotated together with the support and the roller in such a way that the belt moves back into the predetermined path.

From U.S. Pat. No. 5,717,984, a system for guiding and controlling an electrophotographic belt or band is known that includes a guide roller and a drive motor that acts on the guide control roller. A similar system, with a somewhat different design, is known from European Patent Document EP-A2-608 124.

From Published International Patent Application WO-A-99/08374, a high-precision driveable motor system is known.

From U.S. Pat. No. 5,248,027, a method is known that uses two markings on a belt or band to control the position of the belt; these two markings are acquired by a sensor and a control system drives a step motor in such a way that a guide roller around which the belt runs is pivoted. In this method, the idling, or the play, of the step motor is taken into account and is used by the control system in its calculations. The way in which this idling is determined is not addressed and also not described in this reference.

Finally, from European Patent Document EP-A1-0 699 968, an apparatus for controlling a web is known that operates using a tiltable web guide roller, whereby a device is provided for compensating an idling of the tilting device. The position of the web is also determined via sensors that acquire the edge of the web. The response characteristic of the tilting device is determined in such a way that tilting takes place first in one direction, and subsequently the device is tilted back in the opposite direction in many small steps, in order to acquire the position of the web by means of the output of the sensors, and from this to project the idling.

In the case of European Patent Document EP-A1-0 699 968, any play that may exist in the tilting device as a whole is calculated, and an attempt is made to compensate this calculated overall play. A targeted elimination of a gear backlash in a geared motor is not addressed there.

From Japanese Patent Document JP-A-4085065, a method is known for determining and compensating the play in a geared motor with reversible operation that is used in a printer. For this purpose, the motor is brought into a first state in a first direction of rotation, and is subsequently rotated in the opposite direction. Here, at the point of reversal the pulse difference of the step motor is acquired, which indicates the play of the motor and is used for its compensation in the reverse operation.

From Japanese Patent Document JP-A-63274574, a drive control system is known for a carriage, operated in reverse operation with a step motor, in a printer, in which at the point of reversal a photocell sensor is used to determine the time that passes, due to the play of the step motor, from the driving of the step motor until the carriage passes by the sensor. In order to compensate the play, the controlling of a print head is correspondingly retarded. However, such a system is relatively unsuitable for electrophotographic devices, because toner dust can settle on the light-conducting elements of the sensor, which can result in functional disturbances.

From Published International Patent Application WO-A-99/08374, a method is known for determining a gear backlash in which a plurality of Hall sensors and a torque sensor are used to detect angular positions and torque relationships between a rotary motor and an output shaft. The measurement results that are thereby achieved can however contain errors, because it cannot always be ensured that the values of the Hall sensors are detected simultaneously with the values of the torque sensor.

SUMMARY OF THE INVENTION

The object of the present invention is to provide a method with which a gear backlash in a geared motor operated in reverse operation can be compensated in targeted fashion.

In order to achieve this aim, the present invention provides a method for compensating a gear backlash of a geared motor that can be operated in reverse operation in an electrophotographic printing machine, in particular for aligning a print medium web by a web guide device that can be adjusted by the geared motor, including the steps of: rotating the geared motor in a first direction of rotation until an end position is reached; rotating the geared motor in the opposite direction of rotation; acquiring a gear backlash at the point of reversal of the rotational motion by means of a sensor; calculating, using the sensor output, the time T that elapses during the change of direction of rotation without change in the sensor output, and which indicates the gear backlash; and applying the calculated time T in reverse operation for a correspondingly longer driving of the geared motor in order to compensate the gear backlash determined in this way, whereby the sensor is a Hall sensor that acquires the end position, and whereby the rotation takes place in the opposite direction until the Hall sensor signal decays.

An apparatus for carrying out the method is also provided, in which the gear backlash of the geared motor can be acquired separately in each direction of rotation by means of two sensors, and in which the web guiding device consists of a combination of a control bar and a drive roller.

BRIEF DESCRIPTION OF THE DRAWINGS

The object indicated above, as well as the features and advantages of the present invention, can be better understood in connection with the following detailed description of preferred specific embodiments of the present invention, and taking into account the associated Figures.

DETAILED DESCRIPTION OF THE PREFERRED EMBODIMENTS

Figure 1:
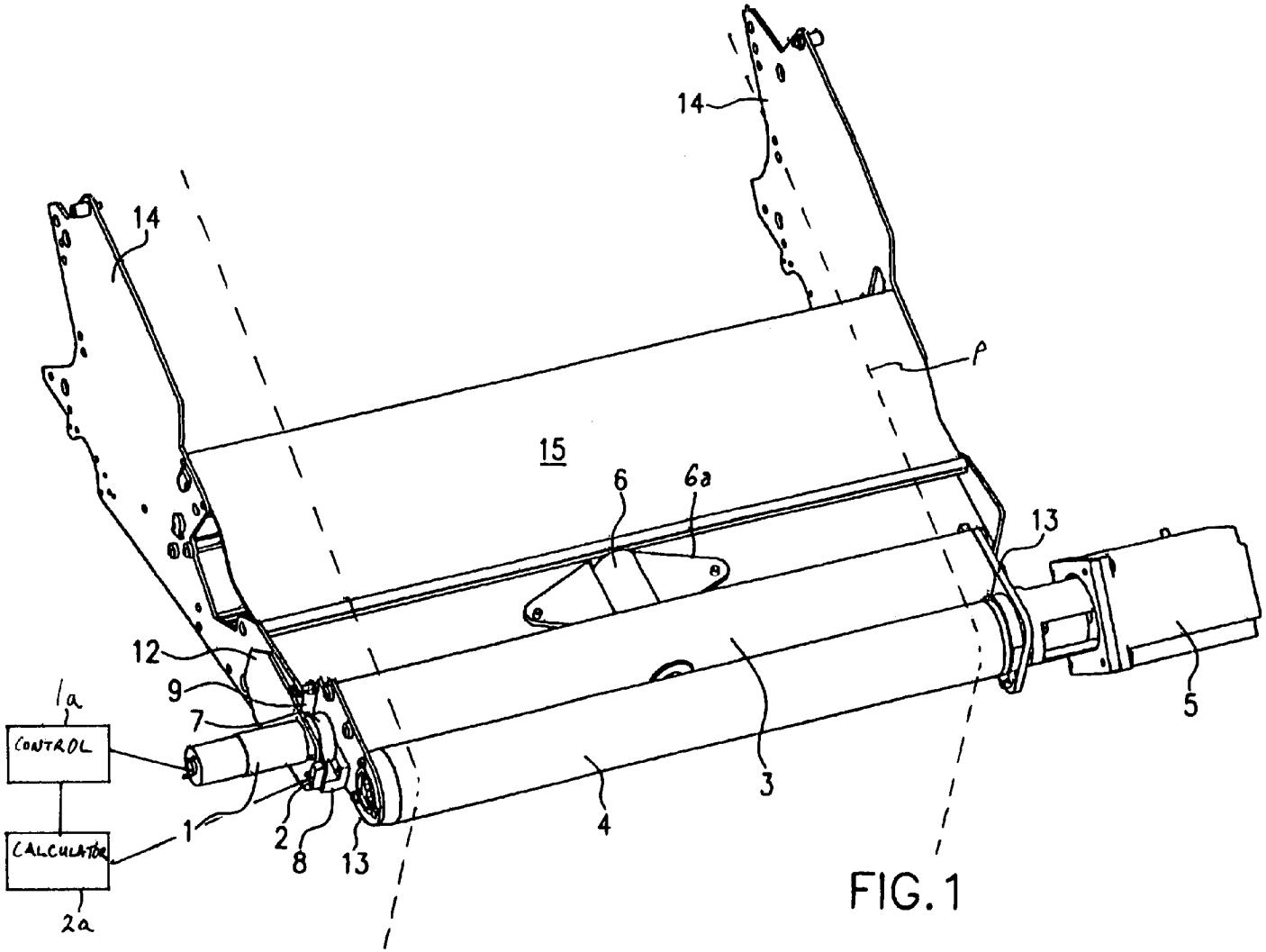
FIG. 1 is a perspective view of an apparatus for aligning a print medium web in an electrophotographic printing device.

In FIG. 1, an apparatus is shown for aligning a print medium web that can be used in particular in an electrophotographic printing device.

Such printing devices or printing machines, in which the present invention is to be used, are described in detail in Published International Patent Applications WO-A1 01/11432 and in WO-A1-00/34831, which are incorporated herein by reference.

The apparatus comprises a geared motor 1 that is fastened to a holding plate 12, this holding plate 12 being fastened in turn to a mounting or assembly plate 14. This mounting plate 14 is present as two pieces, between which a support plate 15 is situated, over which the print medium web (not shown) is transported.

The geared motor 1 is used to pivot a control bar 3 and a drive roller 4 about a tilt axle 6. Tilt axle 6 runs essentially perpendicular to the direction of conveying of the print medium web, which is indicated in dotted outline at P. As illustrated, the tilt axle 6 is supported in a bracket 6*a*.

A drive motor 5 is mounted on a bearer plate 13, and is used to drive the drive roller 4, which conveys the print medium web P.

The geared motor 1 is connected to a control 1*a*. Sensors 2, as will be described in further detail hereinafter are connected to a calculator 2*a*, which in turn is connected to the control 1*a*, the control 1*a* and calculator 2*a* may be functional aspects of the same device.

In FIG. 1, the print medium web P is conveyed coming from below and moving upward around the drive roller 4, and continuing over the control bar 3 and the support plate 15.

Figure 2:
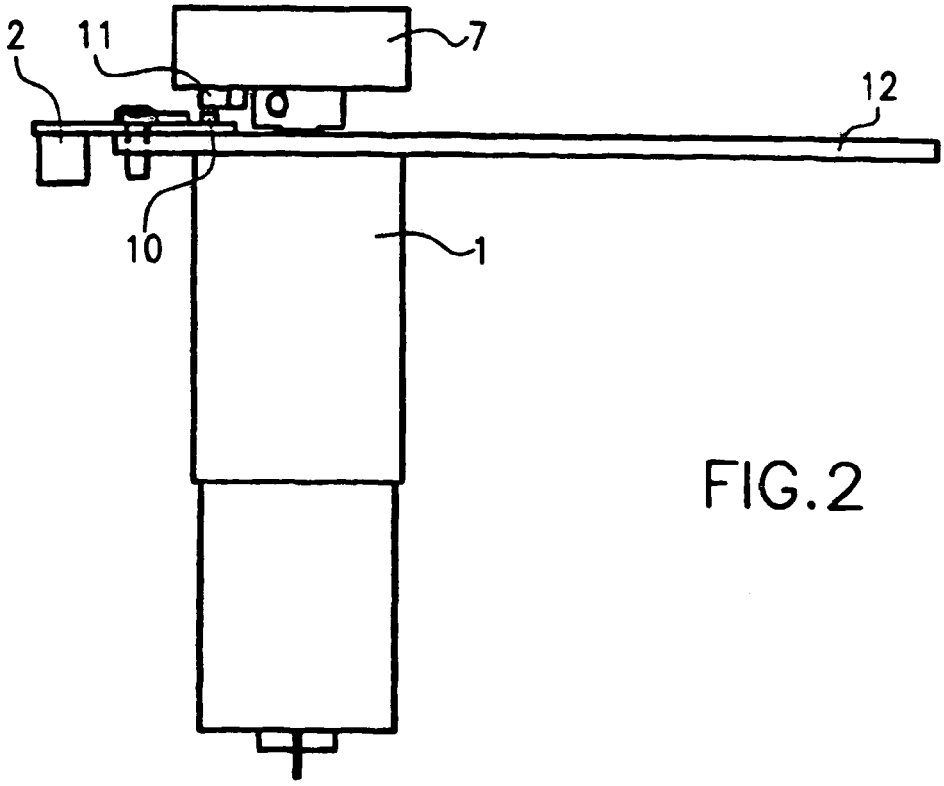
FIG. 2 is a schematic enlarged view of a geared motor that is fastened to a holding plate in the printing device.
Figure 3:
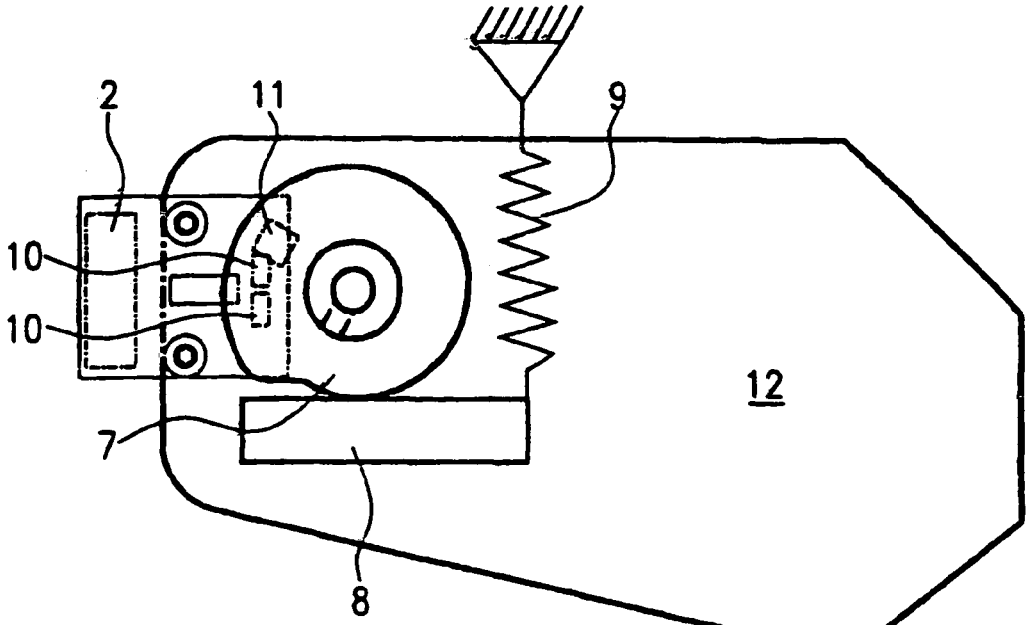
FIG. 3 is a side view of the holding plate according to FIG. 2, in which the positioning of a sensor printed circuit module is shown.

As can be seen in FIGS. 2 and 3, a sensor printed circuit module 2 is mounted next to the geared motor 1 on the holding plate 12. At the output of geared motor 1 there is mounted a cam disk 7 that is rotated by the geared motor 1.

The cam disk 7 lies against a cam disk counter-support, or cam plate, 8, so that when there is a rotation of the cam disk 7, which has a shaped outer profile, the cam plate 8 is correspondingly deflected. In order to bring the cam plate 8 back into an initial position, a tension spring 9 is provided that loads cam plate 8 with a spring force.

A sensor printed circuit module 2 includes a magnet 11, as well as, in the specific embodiment shown, two Hall effect sensors 10. These sensors 10 are used to acquire, or sense, the gear backlash of the geared motor 1.

The gear backlash compensation according to the present invention, for example in a control circuit for adjusting the web edge of a print medium web P, is performed as follows: the geared motor 1, which is a DC motor, drives the cam disk 7 to deflect the control bar 3. However, at each change of direction of rotation the geared motor 1 has a certain amount of reverse play. This reverse play must be determined and taken into account at each reversal of the direction of rotation, for example as a time correction factor.

The gear backlash can be determined as follows:

1. In a finally assembled printing device (in which the print medium has not been supplied), in order to carry out a final functional test the control bar 3 is tilted into an end position using the geared motor 1. The Hall effect sensor 10 monitors the end position. Subsequently, the direction of rotation of the geared motor 1 is reversed. A measurement is made, preferably, of the time that elapses until the Hall sensor signal decays again. This measured time, minus the hysteresis of Hall sensor 10, yields the correction time T that must be taken into account when there is a change of the direction of rotation. The correction time T is determined analogously for the other direction of rotation, as well.

2. In a finally assembled printer, the gear backlash of the geared motor 1 can also be determined on location as needed (for example, during a servicing operation).

3. For the supply of replacement parts, the geared motor 1 can also be measured, and the gear backlash determined, outside the device. For this purpose, geared motor 1 is installed in a suitable device that replaces the control bar with a cam disk countersupport that is loaded with a spring or with a weight. If this geared motor 1 is installed in a printer, the previously determined correction time can be inputted into the device control system.

The geared motor 1 is controlled via what is known as an H-bridge (e.g., an L298 dual full bridge driver chip), which is connected to the motor terminals in order to stop the motor. The cam disk 7 is moved and applied only in a range with a slow and uniform increase, whereby the magnet 11 is fastened to the cam disk 7, and the two Hall effect sensors 10 (e.g., a UGN3140 sensor) are mounted on the sensor printed circuit module 2. The two Hall sensors 10 permit a radius of action of approximately 300°.

The two Hall sensors 10 act as end switches that stop the geared motor 1 immediately when there is a response.

Figure 4:
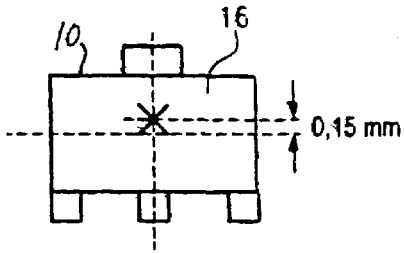
FIG. 4 is a detailed view of a sensor.

In FIG. 4, it is shown that there is provided a Hall sensor 10 having a measurement surface 16 that has a spacing to the midpoint of the sensor of approximately 0.15 mm.

In order to determine the reverse play, the cam disk 7 with a magnet 11 is rotated in one direction of rotation into the end position until the corresponding Hall sensor 10 responds, whereby the geared motor 1 is immediately halted, via shorting of the terminals of the motor via the above-mentioned H-bridge. The direction of rotation is then reversed, and the time is measured between the start of the geared motor 1 and the decaying of the signal at Hall sensor 10.

The gear backlash can then be calculated from the following (measurement) quantities:

EXAMPLE

Motor speed: 3000 RPM

Gearing ratio: 400:1

Magnet/axle radius: 15 mm

Distance a: 1 mm (between the magnet 11 and the Hall effect sensor 10)

Figure 5:
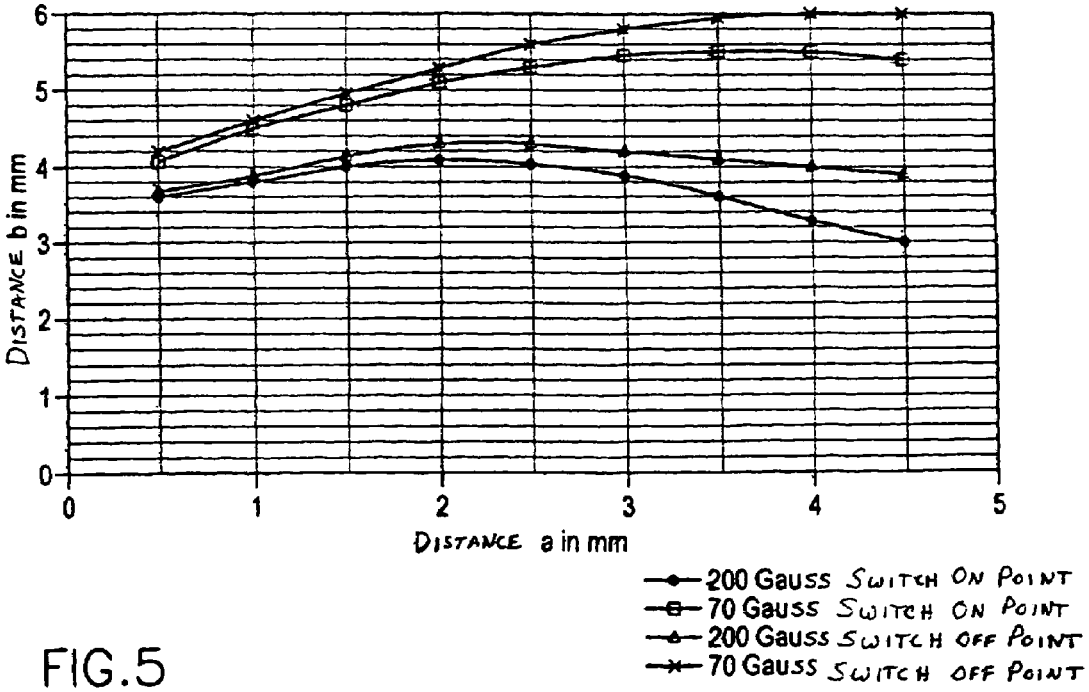
FIG. 5 is a diagram in which the response sensitivity of the sensor is shown dependent on the distance from a magnet.

Hysteresis Δb of the Hall sensor 10 in mm=distance between the switch-on/switch-off characteristic curves at the same magnetic field strength in FIG. 5, for a=1 mm: 0.1 mm Measured time: 30 ms (between start of the motor and decay of the signal from the Hall effect sensor signal)

Using the following equations, the time T can then be calculated:

Motor revolutions/ms=3000 RPM=50 revolutions per second=0.05 revolutions per ms

Motor speed/gearing ratio=(0.05 rev/ms)/400=0.000125 revolutions of the cam disk/ms Circumference of the magnet path=radius+radius*π=15+15*π=94.2477 mm Circumference*cam disk rev/ms=94.2477*0.000125=0.0117809 cam disk path/ms Hysteresis compensation=hysteresis/(cam disk path/ms)=0.1/0.0117809=8.49 ms Reverse play=measured time−hysteresis compensation=30−8.49=21.51 ms In this sample calculation, the reverse play is approximately 21.51 ms; i.e., when there is a change of the direction of rotation, the geared motor 1 must be driven 21.51 ms longer. The presuppositions for the determination of the reverse play or gear backlash using the Hall sensors 10 are as follows:

a) Constant distance a between the Hall sensor 10 and the magnet 11.

b) Exploitation of the linear area of the characteristic curve (see FIG. 5) of the Hall effect sensor 10, so that distance a should be approximately 0.5 mm to 1.5 mm.

c) The hysteresis of the Hall sensor 10 should remain approximately constant over its lifespan, its response value being approximately 70 to 200 Gauss.

In FIG. 5, the characteristic curves of the Hall effect sensor 10 chosen as an example (UGN3140) are shown. The four characteristic curves respectively show the switch-on or switch-off points at 70 or 200 Gauss.

With respect to features of the present invention that have not been explained in more detail above, reference is hereby made explicitly to the patent claims and to the drawings.

In summary, a method is provided for compensating a gear backlash of a geared motor that can be operated in reverse operation, in particular in an electrophotographic printing machine for aligning a print medium web by a web guide device that can be adjusted by the geared motor, which comprises the following steps: rotation of the geared motor in a first direction of rotation until an end position is reached; rotation of the geared motor in the opposite direction of rotation; acquisition of a gear backlash at the point of reversal of the rotational motion by a sensor; calculation of a parameter that indicates the gear backlash using the sensor output; and the application of the calculated parameter in reverse operation for the compensation of the gear backlash determined in this way.

In comparison with the method known from the above-cited European Patent Document EP-A1-0 699 968 for the removal of an overall play in the belt drive of an electrographic device, the present invention has the advantage that, with it, the play in the gear mechanism can be compensated in a targeted fashion. The present invention is based on the recognition that the gear mechanism exerts a very great influence, indeed the greatest influence, on the play in an overall system having a print medium web.

Advantageously, on the one hand, the measurement of the play of the system is made during the manufacture of the web drive system at the factory, because only a relatively simple measurement device for the gear backlash need be used. On the other hand, the later exchange of the gear mechanism, after a shorter or longer period of operation, is facilitated, because, due to the present invention, it is not necessary to measure the overall web transport system at its location of use, which may be situated halfway around the world from the point of manufacture; rather, it is sufficient to measure the gear mechanism at its point of manufacture, and to supply it, together with the determined correction values, for exchange in the printing machine. It is then necessary only to enter the correction values into the machine, and precise printing can again be carried out.

Although other modifications and changes may be suggested by those skilled in the art, it is the intention of the inventors to embody within the patent warranted hereon all changes and modifications as reasonably and properly come within the scope of their contribution to the art.

The invention claimed is:

1. A method for compensating gear backlash of a geared motor that can be operated in reverse operation in an electrophotographic printing machine, comprising the steps of:

rotating the geared motor in a first direction of rotation until an end position is reached;

rotating the geared motor in an opposite direction of rotation, said opposite direction of rotation being opposite to said first direction;

acquiring a gear backlash at a point of reversal of the rotational motion by a sensor, said sensor producing a sensor output signal;

calculating, using the sensor output, a time that elapses during a change of direction of rotation without change in the sensor output, said time indicating the gear backlash; and applying the time in the reverse operation for a correspondingly longer drive of the geared motor in order to compensate the gear backlash, said sensor is a Hall effect sensor that acquires the end position, and said rotating step in the opposite direction takes place until the Hall effect sensor signal decays.

2. A method as claimed in claim 1, further comprising the steps of:

aligning a print medium web by a web guide device that is adjustable by the geared motor.

3. A method as recited in claim 1, wherein hysteresis of the sensor is included in said step of calculating the time.

4. A method as recited in claim 1, wherein the time determined in said calculating step is a first time, and further comprising the step of: determining a second time separately from said first time for a second end position of the geared motor.

5. A method as recited in claim 1, wherein said steps of rotating the geared motor is carried out without a built-in load.

6. A method as recited in claim 1, wherein said steps of rotating the geared motor is carried out with a built-in load.

7. A method as recited in claim 6, wherein said built-in load is achieved by a counter-support that is loaded by at least one of a spring and a weight, and rotating the geared motor against the counter-support.

8. An apparatus for compensating gear backlash of a geared motor that can be operated in reverse operation to adjust a print web in an electrophotographic printing device, comprising:

a control connected to the geared motor to rotate the geared motor in a first direction of rotation until a first end position is reached and to rotate the geared motor in an opposite direction of rotation, said opposite direction of rotation being opposite to said first direction, said control rotating said geared motor to a second end position in said opposite direction and then rotating said geared motor in said first direction from said second end position;

a first Hall effect sensor mounted to acquire a gear backlash at a point of reversal of the rotational motion at said first end position, said first sensor producing a first sensor output signal;

a second Hall effect sensor mounted to acquire a gear backlash at a point of reversal of the rotational motion at said second end position, said second sensor producing a second sensor output signal;

a calculator connected to receive the first and second sensor output signals to calculate a time that elapses during a change of direction of rotation of the geared motor until the sensor output decays, said time indicating the gear backlash, said calculator providing said time to said control to apply the time in the reverse operation of the geared motor for a correspondingly longer drive of the geared motor in order to compensate the gear backlash; and a control bar connected to said geared motor and a drive roller connected to said control bar to effect guiding of the print web.

9. An apparatus as recited in claim 8, further comprising:

a tilting axle extending perpendicular to a direction of transport of the print web, said drive roller being adjustable about said tilting axle.

10. An apparatus as recited in claim 8, wherein the the geared motor is used in the electrophotographic printing machine for orientation of the print web in reverse operation in such a way that an edge of the print web is adjusted in a predetermined range.

11. An apparatus as recited in claim 10, wherein said control stores the times for the gear backlash in the two directions of rotation.

12. A method for compensating a gear backlash of a geared motor that can be operated in reverse operation in an electrophotographic printing machine, comprising the steps of:

rotating the geared motor in a first direction of rotation until an end position is reached;

rotating the geared motor in an opposite rotation direction to said first direction of rotation;

acquiring a gear backlash at a point of reversal of rotational motion by a sensor;

calculating a time that elapses during a change of direction of rotation without change in output of the sensor using an output of the sensor, said time indicating gear backlash of the geared motor;

applying the time calculated in said calculating step for a correspondingly longer driving of the geared motor in order to compensate the gear backlash determined in this way;

the sensor being a Hall sensor that acquires an end position;

said step of rotating in the opposite direction taking place until a signal from the Hall sensor decays; and said geared motor being an adjustment motor for aligning a print medium web by a web guide device in a printer and said steps of rotating said geared motor adjusts said web guide device.

13. A method as recited in claim 12, wherein said end position is a first end position and further comprising the steps of:

rotating said geared motor in said opposite direction until a second end position is reached;

rotating said geared motor in said first direction from said second end position;

acquiring gear backlash at a point of reversal of rotational motion from said second end position by a sensor;

calculating a second time that elapses during a change of direction of rotation from said second end position without change in output of the sensor using an output of the sensor, said second time separately indicating gear backlash of the geared motor.

14. A method as claimed in claim 12, wherein said steps of rotating said geared motor takes place with a built-in load.

15. A method as recited in claim 14, wherein said built-in load is a loaded counter support against which the geared motor is rotated.

16. A method as claimed in claim 15, further comprising the step of:

loading said counter support with at least one of a spring and a weight.

17. An apparatus for compensating a gear backlash of a geared motor that can be operated in reverse operation in an electrophotographic printing machine, comprising:

a web guiding device including a drive roller over which a web of print medium moves during a printing operation, and control bar connected to said drive roller vary a position of said drive roller;

a geared motor connected to said control bar, said geared motor being rotatable in first and second opposite directions to move said control bar;

two sensors mounted to sense movement of said web guiding device separately in each direction of rotation of said geared motor; and a controller connected to said geared motor and to said two sensors to determine a time between a start of rotation of said geared motor in an opposite direction and a sensing of movement by said web guiding device by a corresponding one of said two sensors.

18. An apparatus as recited in claim 17, wherein said in which the web guiding device is adjustable about a tilting axle that runs perpendicular to a direction of transport of the print medium web.

* * * * *